US008444300B2

(12) United States Patent
Chang

(10) Patent No.: US 8,444,300 B2
(45) Date of Patent: May 21, 2013

(54) LED LAMP

(75) Inventor: Shao-Han Chang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 309 days.

(21) Appl. No.: 12/941,984

(22) Filed: Nov. 8, 2010

(65) Prior Publication Data

US 2011/0291561 A1 Dec. 1, 2011

(30) Foreign Application Priority Data

May 25, 2010 (CN) ..... 2010 1 0182164

(51) Int. Cl.
*F21V 29/00* (2006.01)

(52) U.S. Cl.
USPC ..... 362/294; 362/373; 362/264

(58) Field of Classification Search
USPC ..... 362/294, 373, 264
See application file for complete search history.

(56) References Cited

U.S. PATENT DOCUMENTS

| | | | | |
|---|---|---|---|---|
| 6,787,999 | B2 * | 9/2004 | Stimac et al. | 315/51 |
| 8,220,970 | B1 * | 7/2012 | Khazi et al. | 362/294 |
| 2008/0049399 | A1 | 2/2008 | Lu | |
| 2008/0219000 | A1 * | 9/2008 | Fan | 362/241 |
| 2011/0317437 | A1 * | 12/2011 | Chang | 362/373 |

FOREIGN PATENT DOCUMENTS

| | | | |
|---|---|---|---|
| CN | 201190980 | Y | 2/2009 |
| CN | 101542188 | A | 9/2009 |
| TW | M350675 | U1 | 2/2009 |

* cited by examiner

*Primary Examiner* — Evan Dzierzynski
(74) *Attorney, Agent, or Firm* — Altis Law Group, Inc.

(57) ABSTRACT

An LED lamp includes a circuit board with a plurality of LEDs switch and a lamp base made of heat dispersing material. The lamp base includes a fastening pedestal. The fastening pedestal includes an accommodating member, a shell, and a plurality of heat diffusion walls. The accommodating member defines a cavity configured for receiving the circuit board. The shell encloses the accommodating member. The plurality of heat diffusion walls connect the accommodating member to the shell. Each of two adjacent heat diffusion walls define an outlet.

5 Claims, 5 Drawing Sheets

LED LAMP

BACKGROUND

1. Technical Field

The present disclosure relates to LED lamps, especially to an LED lamp with excellent heat dispersion.

2. Description of Related Art

When an LED lamp has been turned on for a period of time, heat is generated and has a negative influence on the lifetime and the luminous efficiency of the LED lamp. Therefore an LED lamp with excellent heat dispersion is needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
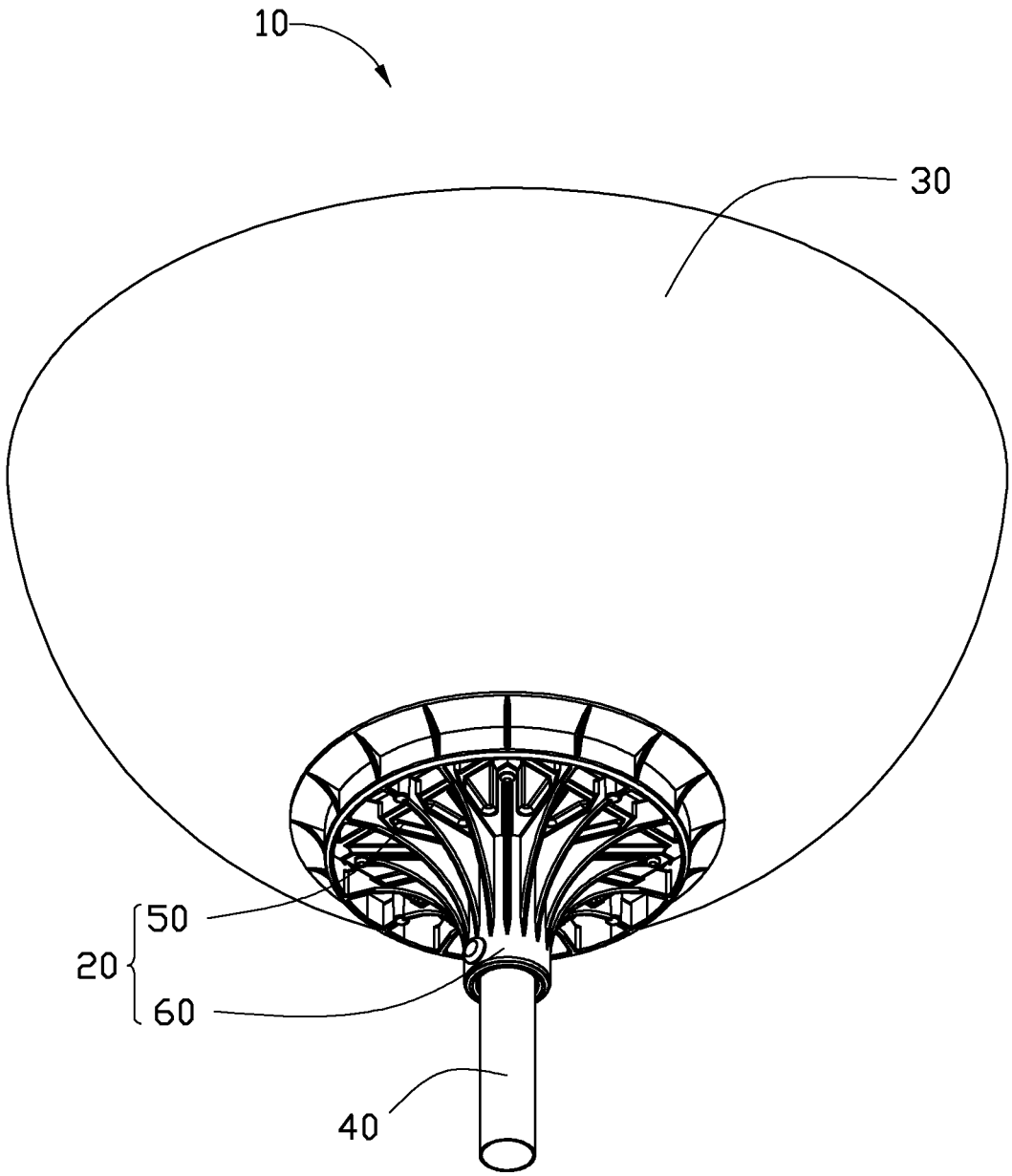
FIG. 1 is an isometric view of an LED lamp according to an exemplary embodiment.
Figure 2:
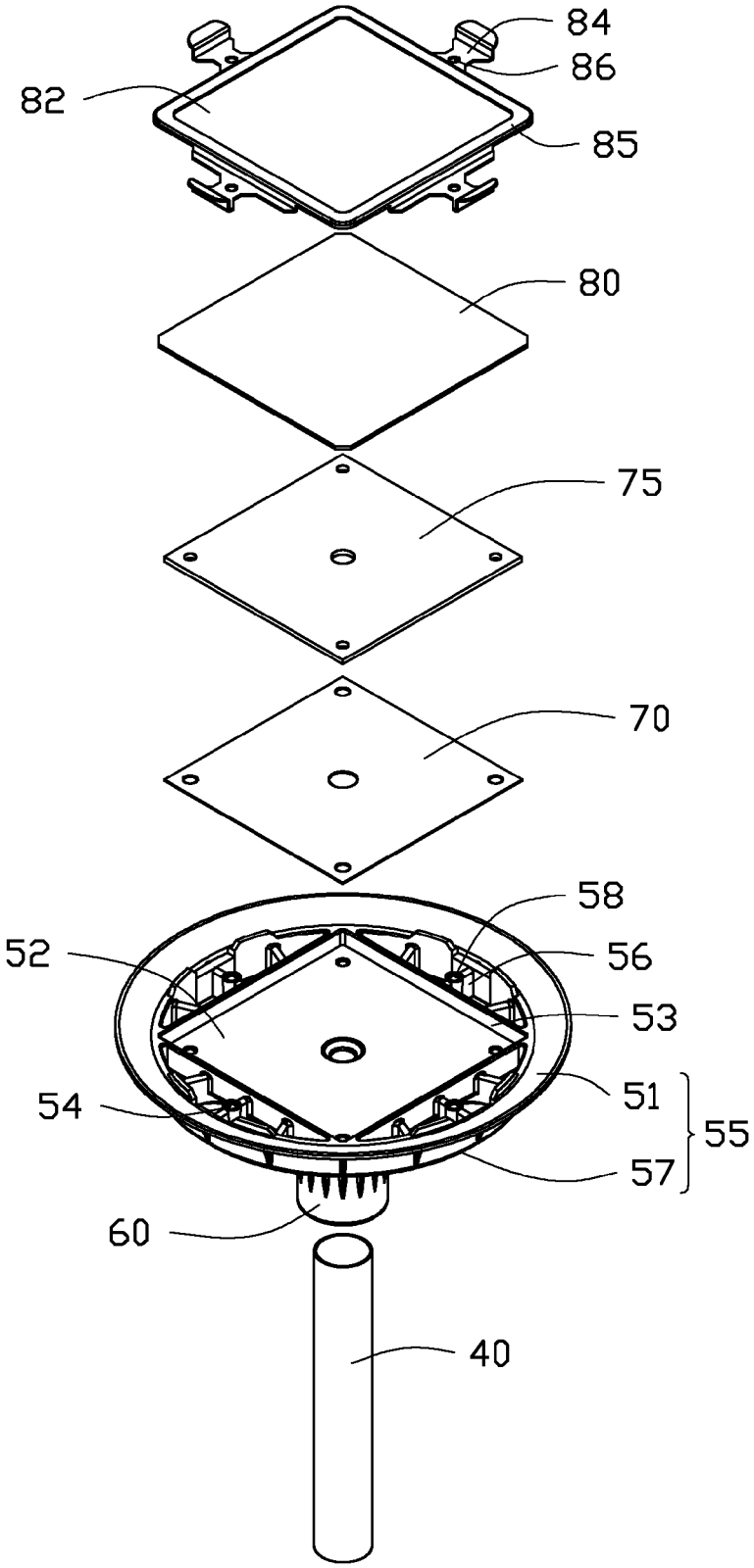
FIG. 2 is an exploded view of the LED lamp of FIG. 1, with a lampshade omitted for clarity.

Referring to FIGS. 1 and 2, an LED lamp 10 includes a lamp base 20, a lampshade 30, a bar-shaped support 40, a cooling plate 70, a circuit board 75 with a number of LEDs (not shown), a transparent plate 80, and a frame 85.

The lamp base 20 is made of heat dispersing material with good heat conductivity, such as aluminium alloy. The lamp base 20 includes a disk-shaped fastening pedestal 50 and a holder 60 protruding from the center of the fastening pedestal 50. The support 40 is fixed to the holder 60. The lampshade 30 is fixed to one end of the fastening pedestal 50 away form the holder 60.

The fastening pedestal 50 includes an accommodating member 53, a shell 55, and a number of heat diffusion walls 56. The shell 55 includes a first heat dissipating portion 57 and a second heat dissipating portion 51. The first heat dissipating portion 57 encloses the accommodating member 53. The second heat dissipating portion 51 extends outward from an edge of the first heat dissipating portion 57. The lampshade 30 is fixed to the second heat dissipating portion 51.

Figure 5:
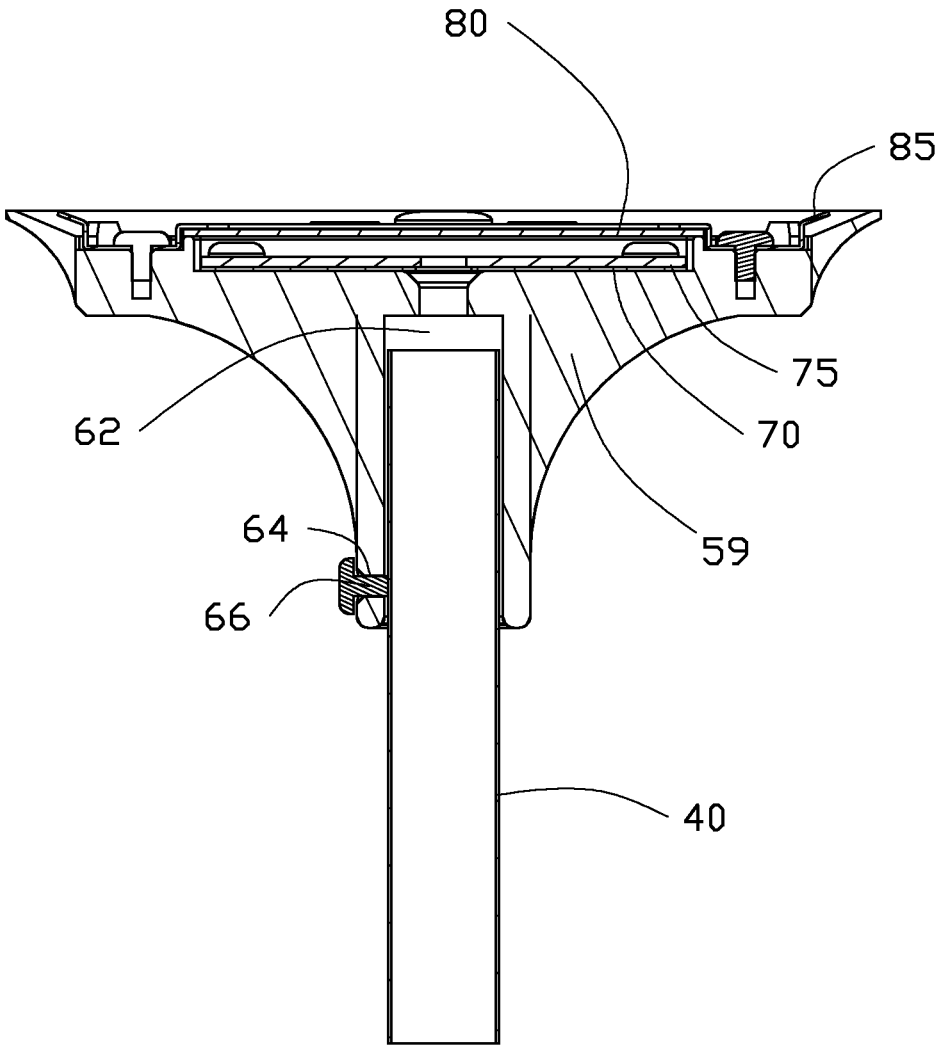
FIG. 5 is a cross-sectional view taken along line IV-IV of FIG. 4.

The accommodating member 53 defines a cavity 52. The cooling plate 70 and the circuit board 75 are both received in the cavity 52 and the circuit board 75 is disposed above the cooling plate 70. Referring to FIG. 5, the cooling plate 70 and the circuit board 75 can be fixed to the accommodating member 53 by bolts (not labeled). The heat generated by the LEDs is conducted to the accommodating member 53 and the holder 60 in an axial direction and is dispersed to the air via the outside surface of the holder 60.

The heat diffusion walls 56 connect the accommodating member 53 to the first heat dissipating portion 57 in a radial arrangement. The heat diffusion walls 56 are configured for conducting the heat generated by the LEDs to the first heat dissipating portion 57 in a radial direction. The surface of the second heat dissipating portion 51 disperses the heat conducted from the first heat dissipating portion 57. Each two adjacent heat diffusion walls 56 define an outlet 54. The warm air in the LED lamp 10 communicates with the outside air via the outlet 54 to disperse the heat.

Figure 4:
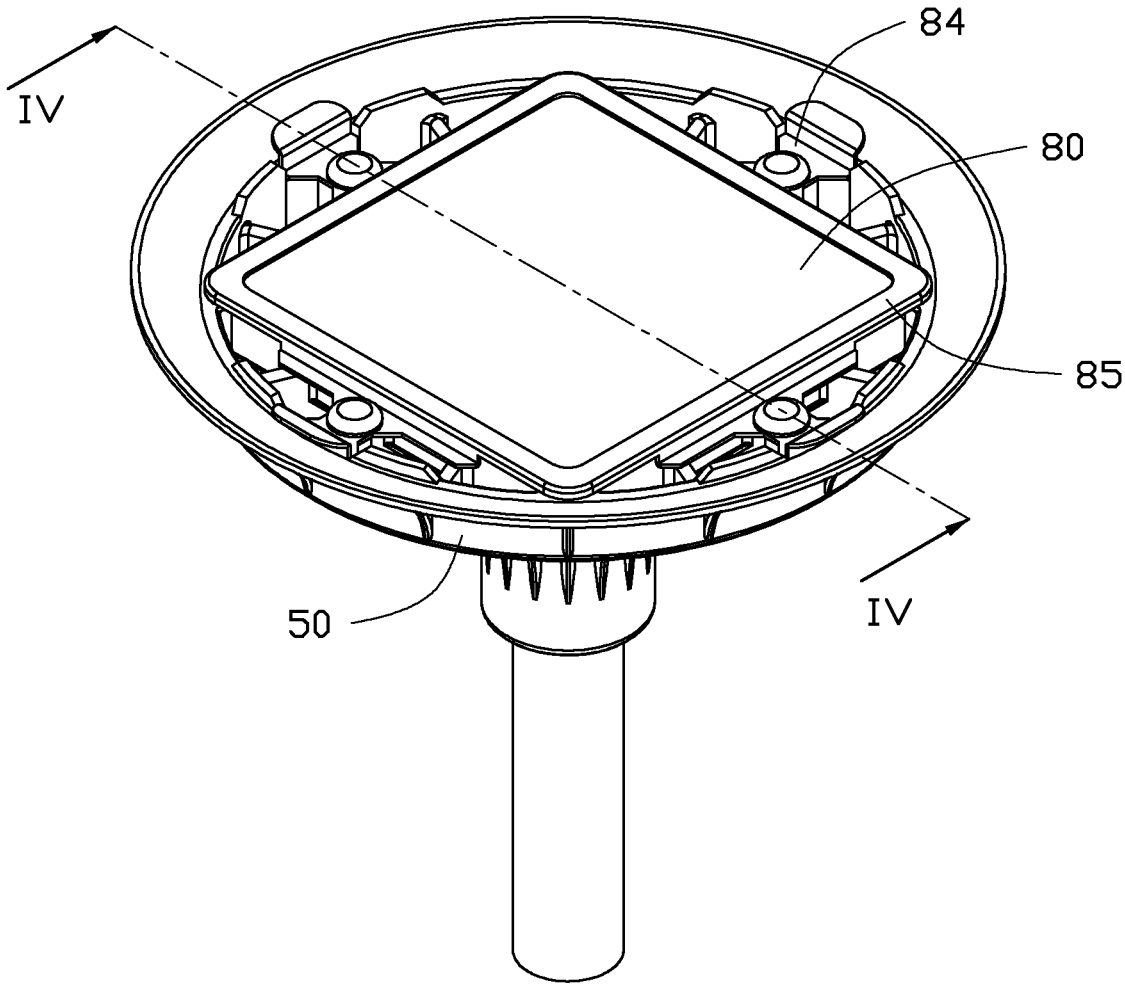
FIG. 4 is an isometric view of the LED lamp of FIG. 1, with the lampshade omitted for clarity.

Each of the heat diffusion walls 56 defines a receiving hole 58. The transparent plate 80 is also received in the cavity 52. The frame 85 defines an opening 82. The area of the opening 82 is smaller than that of the transparent plate 80. A number of fastening sheets 84 extend from an edge of the frame 85. The fastening sheets 84 define a number of holes 86 corresponding to the receiving holes 58 of the heat diffusion walls 56. Referring to FIG. 4, bolts (not labeled) extend through the holes 86 and engage in the receiving holes 58, thereby fixing the frame 85 to the fastening pedestal 50, to restrict the transparent plate 80 in the cavity 52.

Figure 3:
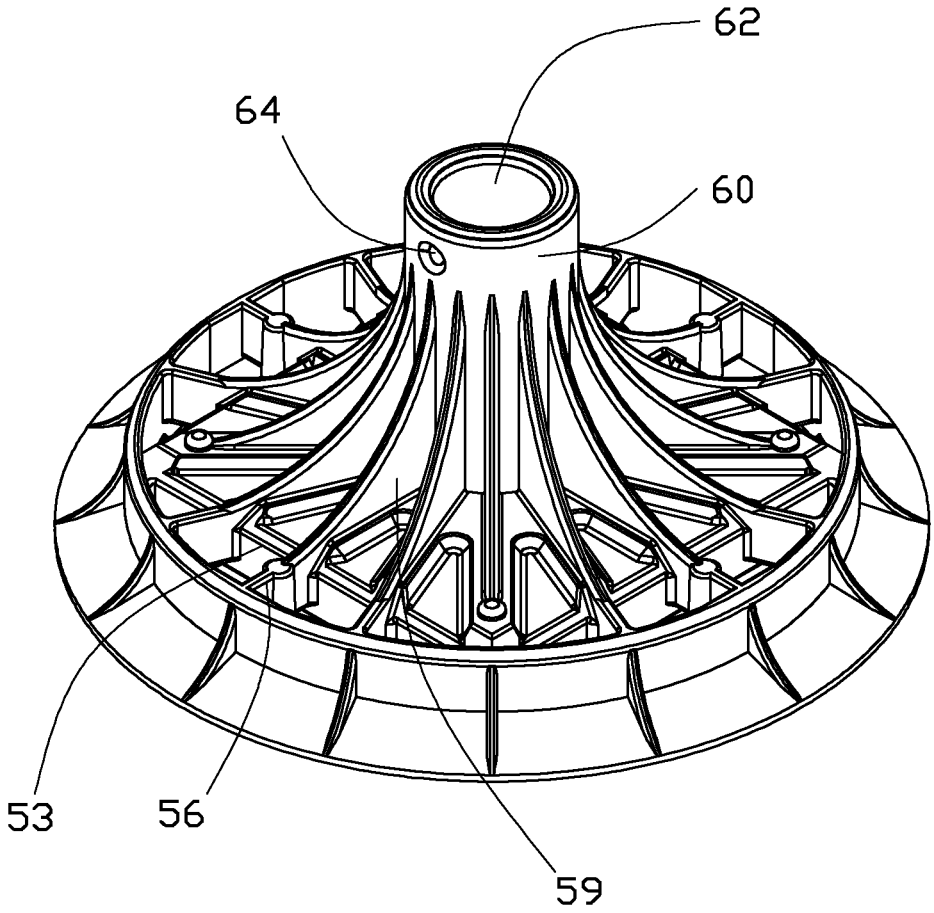
FIG. 3 an isometric view of a lamp base of the LED lamp of FIG. 1, but viewed from a different aspect.

Referring to FIG. 3, the accommodating member 53 includes a number of fins 59 arranged around the holder 60. The fins 59 connect the heat diffusion walls 56 to the outside surface of the holder 60 to homogenize the heat between the holder 60 and the accommodating member 53. The fins 59 further disperse the heat conducted from the holder 60 and the accommodating member 53.

Referring to FIG. 5, the holder 60 defines a receiving space 62 along its axial direction and a hole 64 in its lateral surface. One end of the support 40 is received in the receiving space 62. The hole 64 is configured for receiving a bolt 66 to connect the holder 60 to the support 40. The support 40, the fastening pedestal 50, the cooling plate 70 and the circuit board 75 are all formed with a through hole (not labeled) aligned with the receiving space 62. A power cord (not shown) extends through the receiving space 62 and the through holes and is electrically connected to the circuit board 75. Power can be provided to the LEDs by the power cord.

The LED lamp 10 is capable of homogenizing the heat therein and dispersing the heat in all directions, thereby achieving excellent heat dispersion.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED lamp comprising:

a circuit board with a plurality of LEDs; and a lamp base made of heat dispersing material;

wherein the lamp base comprises a fastening pedestal, the fastening pedestal comprises an accommodating member, a shell, and a plurality of heat diffusion walls, the accommodating member defines a cavity configured for receiving the circuit board, the shell encloses the accommodating member, the heat diffusion walls connect the accommodating member to the shell, each of two adjacent heat diffusion walls define an outlet; the lamp base further comprises a holder protruding from the fastening pedestal, the accommodating member includes a plurality of fins arranged around the holder, the fins are configured for connecting the heat diffusion walls to the holder.

2. The LED lamp of claim 1, wherein the shell comprises a first heat dissipating portion and a second heat dissipating portion, the second heat dissipating portion extends outward from an edge of the first heat dissipating portion, the heat diffusion walls are connected to the first heat dissipating portion.

3. The LED lamp of claim 2, further comprising a lampshade fixed to the second heat dissipating portion.

4. The LED lamp of claim 1, further comprising a cooling plate, wherein the cooling plate is received in the cavity, the circuit board is disposed above the cooling plate.

5. The LED lamp of claim 1, further comprising a transparent plate and a frame, wherein the frame defines an opening, the area of the opening is smaller than that of the transparent plate, the transparent plate is received in the cavity, the frame is fixed to the fastening pedestal to restrict the transparent plate in the cavity.

* * * * *